United States Patent [19]

Miskinis

[11] 4,391,779

[45] Jul. 5, 1983

[54] TEFLON GROUND GLASS ADAPTOR

[76] Inventor: Robert J. Miskinis, 9758 Airport Vista Rd., Santee, Calif. 92071

[21] Appl. No.: 280,361

[22] Filed: Jul. 6, 1981

[51] Int. Cl.[3] ..... B01L 11/00

[52] U.S. Cl. ..... 422/99; 422/102; 81/3.1 C; 81/3.34; 215/296

[58] Field of Search ..... 215/295, 296; 285/18; 138/96 R, 96 T; 81/3.1 R, 3.1 C, 3.34; 422/103, 102, 99

[56] References Cited

U.S. PATENT DOCUMENTS

| | | | |
|---|---|---|---|
| 2,052,713 | 9/1936 | Juffa | 422/103 |
| 2,801,017 | 7/1957 | Cortat | 215/296 |
| 3,323,874 | 6/1967 | Philips | 422/103 |

FOREIGN PATENT DOCUMENTS

| | | | |
|---|---|---|---|
| 9792 | of 1891 | United Kingdom | 215/296 |

OTHER PUBLICATIONS

Sargent Welch Cat. 1971, pp. 309, 1008, 1010, 1011.

*Primary Examiner*—Michael S. Marcus
*Attorney, Agent, or Firm*—George J. Rubens

[57] ABSTRACT

An adaptor for ground glass joints or couplings for laboratory glassware includes a Teflon body member having male and female coupling portions and a retracting nut threadably mounted on one end of the coupling member for engaging the end of a female joint member for retraction of the male member therefrom. An alternate embodiment comprises a Teflon stopper having a retracting nut.

7 Claims, 4 Drawing Figures

TEFLON GROUND GLASS ADAPTOR

BACKGROUND OF THE INVENTION

The present invention relates to laboratory equipment and pertains particularly to an adaptor for ground glass couplings. Chemcial laboratory equipment includes a great many glass vessels, flasks and tubing which may be coupled and uncoupled in various configurations to set up the appropriate equipment. Reducing adaptors are utilized for coupling of different size tubings and couplings different size tubings to glass flasks and the like. Such couplings and the joints between such adaptors and the tubings or vessels are usually ground glass very slightly tapered at 5 degrees 43'(known as a Standard Taper, as specified by the American Standard Testing and Manufacturing organization [ASTM]) to insure a secure fit. Such joints are usually coated with a silicon grease in order to seal the joints and prevent leakage.

For the purpose of this specification, the term stopper is defined to include a stopper having a bore opening for reducing or enlargening the diameter of glassware openings, commonly referred to in the art as adapters, and to also include a stopper having a solid body used as a plug to close glassware openings.

The problem with such ground glass adaptors is that the silicon may contaminate the test sepcimen, and upon sitting for some time adaptors and stoppers tend to freeze and can't be removed. Such silicon grease also makes clean-up time consuming and unpleasant.

It is therefore desirable that an improved coupling be available for ground glass laboratory equipment.

SUMMARY AND OBJECTS OF THE INVENTION

It is the primary object of the present invention to provide an improved adaptor for ground glass couplings.

In accordance with the primary aspect of the present invention, an adaptor for ground glass laboratory couplings comprises a body of a synthetic resin polymer material, such as that sold under the trademark Teflon, formed to define male and female coupling joints and including retractor means for applying a force for removal of the male adaptor portion from a female coupling.

BRIEF DESCRIPTION OF THE DRAWINGS

The above and other objects and advantages of the present invention will become apparent from the following description when read in conjunction with the drawings, wherein.

DETAILED DESCRIPTION OF PREFERRED EMBODIMENTS

Figure 1:
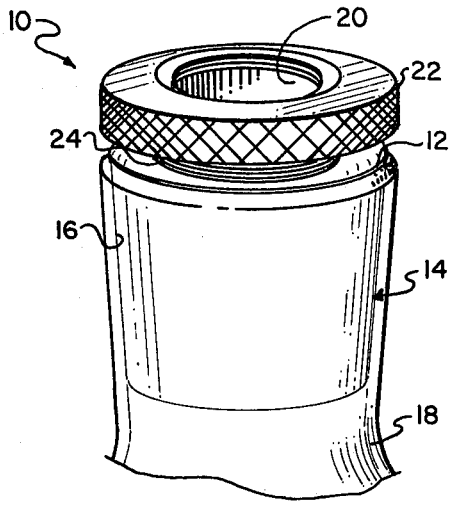
FIG. 1 is a perspective view of an adaptor in accordance with the invention as shown in place.
Figure 3:
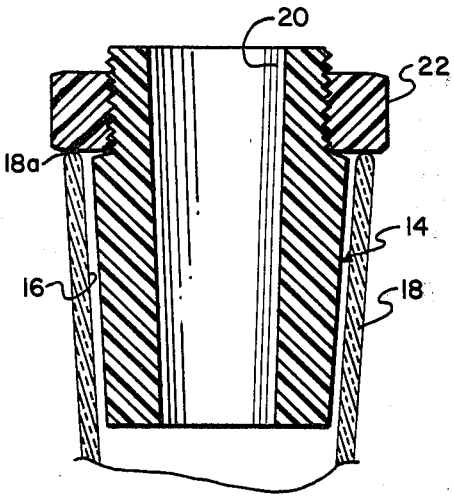
FIG. 3 is a view like FIG. 2 showing the retractor activated.

Turning to the drawing, there is illustrated in FIG. 1 an adaptor in accordance with the invention designated generally by the numeral 10 comprising a body 12 of a somewhat cylindrical configuration having a slighlty tapered outer surface 14 of about 5 degrees 43'±011', commonly referred to as a Standard Taper, for engaging a tapered inner surface 16 of a vessel or glass tubing 18. The coupling surface of neck area 16 of the glass member 18 is ground to provide a uniformly tapered surface for fitting a corresponding ground outer surface of a male coupling member.

Glass tubing utilized in laboratories for conveying liquids to and from flasks, vessels and the like is coupled by Standard Taper ground glass joints with changes in the tube size and diameter accommodated by means of an adaptor which is usually formed of a ground glass member. The body member 12 has an inner cylindrical bore 20 also of a slightly tapered configuration (Standard Taper) forming the female portion of the adaptor member for receiving a reduced diameter ground glass coupling. Thus the coupling member can be utilized for fitting a tube of the diameter of that of the inner bore to a vessel having an inlet diameter on the order of that of the glass member 18.

The member 12 is preferably constructed of a plastic material of a solid substantially rigid consistency, such as a synthetic resin polymer such as that sold under the trademark Teflon.

A retractor includes a nut or collar 22 threadably mounted on a threaded portion 24 of the body member 12. The retractor is to aid in the retraction of the adaptor member from the neck of the joint or vessel 18.

It has been found that plastic materials such as Teflon or the like while making a secure seal with a ground glass coupling or joint cannot be removed from the joint once seated without breaking the glass member. This is particularly so for diameters of greater than ¼ of an inch. For this reason a retractor has been devised which withdraws the adaptor from the female coupling member with a steady uniform coaxial force on the rim **18*a*** of the coupling joint.

Figure 2:
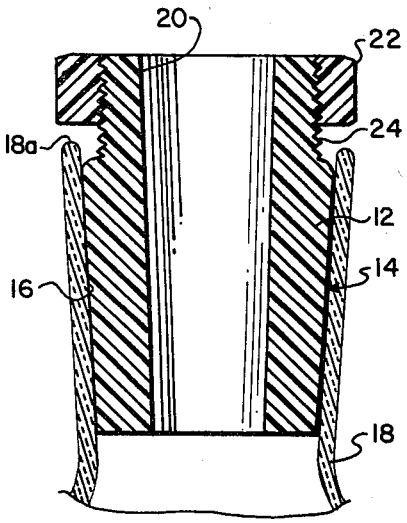
FIG. 2 is a side elevational view in section of the adaptor of FIG. 1.

In operation, in order to couple a glass tubing or the like having a diameter of on the order of that of the bore 20 to a vessel or the like 18 having a diameter on the order of that of neck portion 16, an adaptor 12 is selected and the retractor nut 22 withdrawn upward to a position of non-engagement as shown in FIG. 2, and the adaptor placed within the neck of the vessel 18. A glass coupling tube having a ground outer coupling surface or end is selected to fit within bore 20 and inserted in place. Because of the slight taper of the surfaces of the respective bores, the joints will form a tight and secure seal without the need of silicon grease or the like.

In order to remove the adaptor 12 from the neck of the vessel 18 it will be necessary to exert an enormous coaxial force thereon. This force is applied by the retractor member including collar 22 which is threadably mounted on the threaded neck 24. Rotation of the collar 22 in a clockwise direction translates or moves the collar or nut 22 along the threaded surface 24 for engagement of the underside of the collar 22 with the rim **18*a* of the vessel 18. Continued rotation of the collar forces the adaptor member 12 out of the neck as shown in 13 pulling the outer surface 14 of the adaptor member away from the inner walls 16** of the vessel neck.

Thus the provision of the retractor assembly permits the use of a plastic adaptor member of a large diameter that could not otherwise be utilized. The adaptor member in accordance with the invention can be made in sizes to fit existing laboratory equipment and thus simply replace existing ground glass adaptors where feasible. Various plastic materials may be utilized instead of Teflon polymer where such is desired. Teflon type polymer, however, is preferred because of its properties, such as being inert to most chemicals in research laboratories, providing a substantially self lubricating surface and a superior seal.

Figure 4:
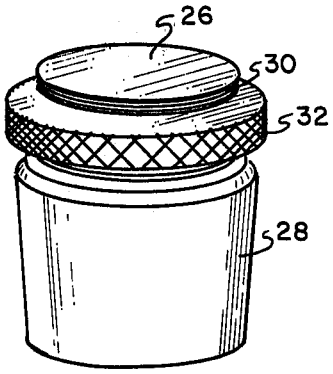
FIG. 4 is a perspective view of an alternate embodiment.

Turning now to FIG. 4, an alternate embodiment of the invention is shown which is simply a plug or stopper for a standard ground glass joint. The stopper member 26 is a solid body of material such as Teflon polymer or the like having a somewhat generally cylindrical configuration having a Standard Taper male surface portion 28 adapted to fit conventional Standard Taper vessel or flask openings to close the same. A threaded upper portion 30 is engaged by a threaded nut or collar 32 forming a retractor assembly for retracting the stopper from the ground joint of a flask or vessel.

The adaptors and plugs in accordance with the inventions are shaped and sized in accordance with conventional dimensions and tapers so as to fit existing laboratory vessels and equipment. The adaptor in accordance with the invention provides an improved alternative to existing glass adaptors.

Thus while I have illustrated and described my invention by means of specific embodiments, it is to be understood that numerous changes and modifications may be made therein without departing from the spirit and scope of the invention as defined in the appended claims.

Having described my invention, I now claim:

1. A resuable stopper for tapered ground openings in standard laboratory glassware:

said stopper having a tapered body portion, and a threaded portion extending from the end of the larger cross-sectional area of the body portion and constructed of a substantially rigid synthetic resin polymer material;

said tapered body portion having a surface conforming to the prescribed surface specifications of standard glassware openings to provide a uniformly sealed connection simultaneously throughout their respective surface upon initial contact when seated;

a one-piece retractor nut having a textured outer surface and mounted on the threaded portion of the stopper, said nut dimensioned to engage the rim of the glassware opening and being smaller in length than said threaded portion;

whereby a slight rotation of the nut will engage the rim of the glassware opening to apply an axial force on the seated body portion sufficient to break the seal between said surfaces enabling the stopper to be lifted freely out of the opening.

2. The stopper of claim 1 having a tapered central through bore.

3. The stopper of claim 1 wherein said body portion is a solid plug.

4. The stopper of claim 1 wherein said textured outer surface is a knurled gripping surface.

5. The combination of a resuable stopper and a standard laboratory glassware having a tapered ground opening; said stopper having a tapered body portion, a threaded portion extending from the end of the larger cross-sectional area of the body portion and constructed of a substantially rigid synthetic polymer material;

said body portion having a surface complimentary to the prescribed surface specifications of the glassware opening to provide a uniform sealed connection simultaneously throughout and between their respective surfaces upon initial contact;

said tapered body portion having dimensions so as to extend directly within the glassware opening and below the rim of the opening when seated therein;

a one piece nut having a textured outer surface mounted on the threaded portion, said nut dimensioned to engage the rim of the glassware opening and being smaller in length than said threaded portion;

whereby a slight rotation of the nut against the glassware opening rim will apply an axial force on the seated body portion sufficient to break the seal between said surfaces enabling the stopper to be lifted freely out of the opening.

6. A reusable stopper for tapered ground openings in standard laboratory glassware said stopper consisting of two separable pieces, namely a knurled nut and a tapered body made of a substantially rigid synthetic resin polymer material;

said body having a reduced cross-sectional threaded neck portion extending from the enlarged end portion of the tapered body portion forming a shoulder therebetween, said tapered body portion having a surface complimentary to the prescribed standard surface specifications of the glassware opening to provide a uniformly sealed connection simultaneously between and throughout their respective surfaces upon initial contact when the stopper is seated in the glassware opening;

said nut engagable with the rim of the glassware opening to apply an axial force on the seated body portion sufficient to break the seal between said surfaces enabling the stopper to be lifted freely out of the glassware opening and being smaller in length then said threaded portion.

7. The stopper of claim 6, wherein the knurled nut has a threaded bore opening extending therethrough, and the diameter of the threaded neck portion is no larger than the diameter of the stopper body to enable the threaded neck portion to extend within the glassware opening and below its rim.

* * * * *